US009750333B1

(12) United States Patent
Wesenhagen

(10) Patent No.: US 9,750,333 B1
(45) Date of Patent: Sep. 5, 2017

(54) BELT CLIP FOR A GOLF CLUB

(71) Applicant: Humphrey Erwin Wesenhagen, Redmond, OR (US)

(72) Inventor: Humphrey Erwin Wesenhagen, Redmond, OR (US)

( * ) Notice: Subject to any disclaimer, the term of this patent is extended or adjusted under 35 U.S.C. 154(b) by 0 days.

(21) Appl. No.: 15/227,296

(22) Filed: Aug. 3, 2016

(51) Int. Cl.
*A45F 5/02* (2006.01)
*A63B 55/10* (2006.01)

(52) U.S. Cl.
CPC ..... *A45F 5/021* (2013.01); *A63B 55/10* (2013.01)

(58) Field of Classification Search
CPC ..... A45F 5/021; A45F 2005/027; A45F 2005/025; A63B 55/10
USPC ..... 224/269, 271
See application file for complete search history.

(56) References Cited

U.S. PATENT DOCUMENTS 2,589,126 A 3/1952 Payne
3,894,667 A * 7/1975 Baldocchi ..... A45F 5/02 224/198
4,424,924 A * 1/1984 Perkins ..... F41B 13/04 224/192
4,830,244 A * 5/1989 Brannon ..... A01K 65/00 224/103
5,540,368 A * 7/1996 Oliva ..... A45F 5/02 224/242
5,573,167 A * 11/1996 Bebb ..... A01K 97/10 224/200
6,283,348 B1 * 9/2001 Wang ..... A45F 5/02 224/197
6,491,191 B1 * 12/2002 Cleveland ..... A45F 5/00 224/251
6,626,334 B2 * 9/2003 Ewing ..... A45F 5/02 224/197
6,848,605 B2 * 2/2005 Dillenberger ..... A45F 5/02 224/242
6,955,280 B2 * 10/2005 Saitoh ..... B60R 11/0241 224/197
6,966,519 B2 * 11/2005 Salentine ..... A45F 5/004 224/162
7,802,706 B1 * 9/2010 Selsor ..... A45F 5/02 224/269
9,038,873 B2 * 5/2015 Moreau ..... A45F 5/00 224/269
2003/0106917 A1 * 6/2003 Shetler ..... A45F 5/02 224/197

(Continued)

*Primary Examiner* — Brian D Nash
(74) *Attorney, Agent, or Firm* — Kintner IP, LLC; Mary Frances Ludwig

(57) ABSTRACT

A wearable belt clip includes a keeper which receives a golf club and is removably attachable to the golfer's belt. The keeper positions the shaft of the golf club so it does not impede the golfer's movements, such as swinging a club or walking. The belt clip allows the golfer to conveniently carry a second golf club without the concern of misplacing it during play. In an embodiment, a keeper channel positions the club head above the keeper with the shaft extending below the keeper. In front view, the keeper channel is substantially parallel to the belt clip longitudinal axis, so that the golf club is held in a substantially vertical orientation. In side view, the keeper channel is angled with respect to the belt channel, so that the head of the golf club is angled away from the wearer, for improved comfort and maneuverability.

7 Claims, 5 Drawing Sheets

(56) References Cited

U.S. PATENT DOCUMENTS

| | | | | |
|---|---|---|---|---|
| 2003/0141329 | A1* | 7/2003 | Huang | A45F 5/02 224/197 |
| 2004/0000569 | A1* | 1/2004 | Good | A45F 5/02 224/269 |
| 2004/0020524 | A1* | 2/2004 | McConnell | A45F 5/00 135/66 |
| 2008/0109976 | A1* | 5/2008 | Sanabia | A45F 5/02 15/106 |
| 2012/0178547 | A1* | 7/2012 | Famulari | A45F 5/021 473/282 |
| 2013/0029774 | A1* | 1/2013 | Davis, Jr. | A63B 55/10 473/282 |
| 2015/0069100 | A1* | 3/2015 | Blood | A45B 1/00 224/269 |

* cited by examiner

BELT CLIP FOR A GOLF CLUB

CROSS REFERENCE TO RELATED APPLICATION

None

TECHNICAL FIELD

The present invention pertains generally to golf accessories, and more particularly to a belt clip for holding a golf club.

BACKGROUND OF THE INVENTION

A golfer will frequently carry two golf clubs when a short distance shot is required to reach the putting green (for example, a putter and a wedge or an iron). Since the second club must be set aside to complete the putt, golfers carrying an extra club often inadvertently leave a club behind when moving on to the next hole. The present invention allows a golfer to carry a club on a belt clip, which is clipped to the golfer's belt or otherwise held at the waistline. The belt clip positions the shaft of the golf club alongside the golfer's leg so that a shot may be taken while wearing the belt clip with the club inserted.

BRIEF SUMMARY OF THE INVENTION

The present invention is directed to a belt clip for a golfer to wear about the waistline. The present invention utilizes a keeper to receive a golf club and a clip for removably attaching the device to the golfer's waistline. The golf club is inserted into the keeper with a simple one-handed motion. The keeper positions the shaft of the golf club in a substantially vertical orientation when the golfer is standing upright, keeping the club out of the way while walking. When the golfer is taking a swing, the club is positioned alongside the golfer's leg so as not to interfere with the golfer's play. The resulting device allows a golfer to carry an extra club on their person without having to set the extra club down while playing, thus avoiding the chance of leaving the extra club behind when advancing to the next hole. While wearing the belt clip and club a golfer can walk, swing, pitch and even putt a ball with ease.

In accordance with an embodiment, the belt clip has front and rear members joined to one another by a top member. The front member has a lateral belt channel which receives a belt. The keeper for the golf club or other device is disposed on an external face of the front member. The front member further has an outwardly curving grip disposed on a bottom edge.

In accordance with another embodiment, the belt clip includes a rear member which has a laterally extended bend separating the rear member into an upper portion and a lower portion. The bend positions the lower portion nearer the belt than is the upper portion, to securely retain the clip in position.

In accordance with another embodiment, the keeper has a keeper channel shaped and dimensioned to receive a shaft of a golf club having a head, so that the head is positioned above the keeper and the shaft extends below the keeper. When viewed from the front, the keeper channel is substantially parallel to a longitudinal axis of the belt clip, so that the golf club is held in a substantially vertical orientation. When viewed from the side, the keeper channel has an angle with respect to the belt channel, so that the head of the golf club is positioned farther away from the belt channel than is the shaft, for improved comfort and maneuverability.

Other embodiments, in addition to the embodiments enumerated above, will become apparent from the following detailed description, taken in conjunction with the accompanying drawings, which illustrate, by way of example, the principles of the belt clip and method of use.

LIST OF DRAWING REFERENCE NUMERALS

Figure 1:
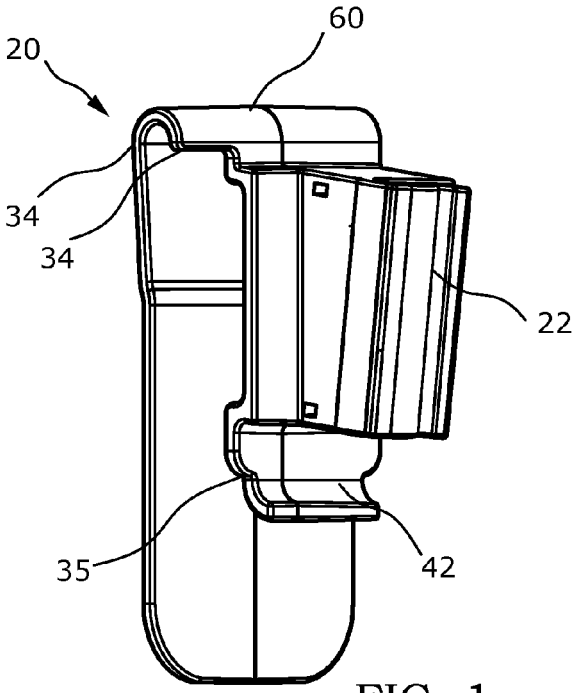
FIG. 1 is a left front perspective view of a belt clip.
Figure 2:
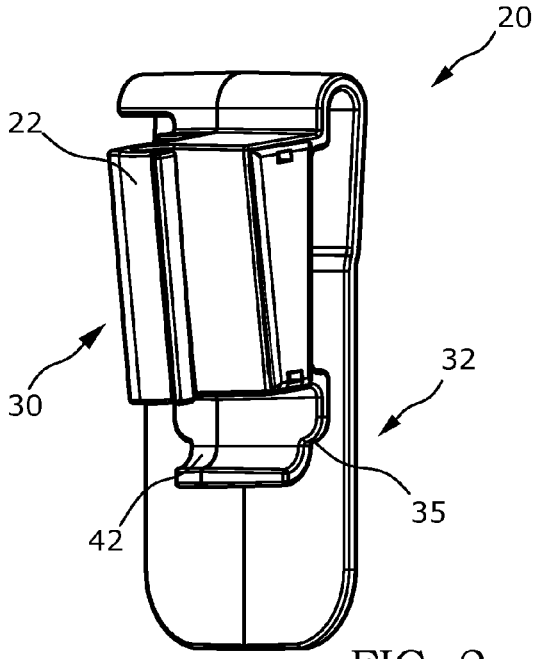
FIG. 2 is a right front perspective view of the belt clip.
Figure 3:
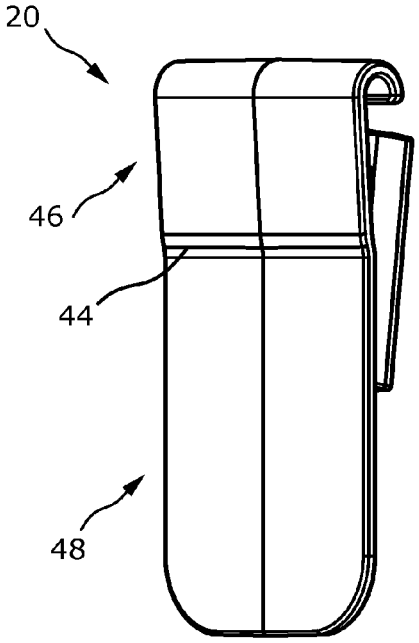
FIG. 3 is a left rear perspective view of the belt clip.
Figure 4:
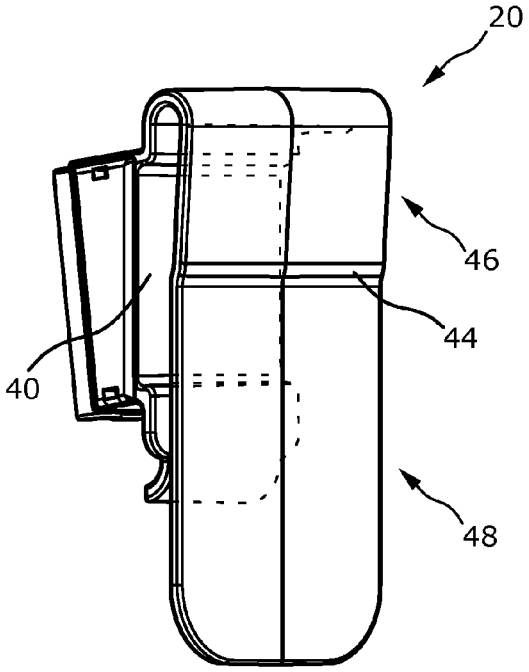
FIG. 4 is a right rear perspective view of the belt clip.

20 belt clip
22 keeper
30 front member
32 rear member
34 top edge
35 bottom edge
36 interior face
38 exterior face
40 belt channel
42 grip
44 bend
46 upper portion
48 lower portion
50 keeper channel
52 keeper grip
53 open top
54 open bottom
55 longitudinal side
60 top member
500 golfer
510 belt
512 belt top edge
514 belt bottom edge
516 belt front face

520 leg
600 golf club
610 shaft
620 head
650 second golf club

DETAILED DESCRIPTION OF THE INVENTION

Figure 5:
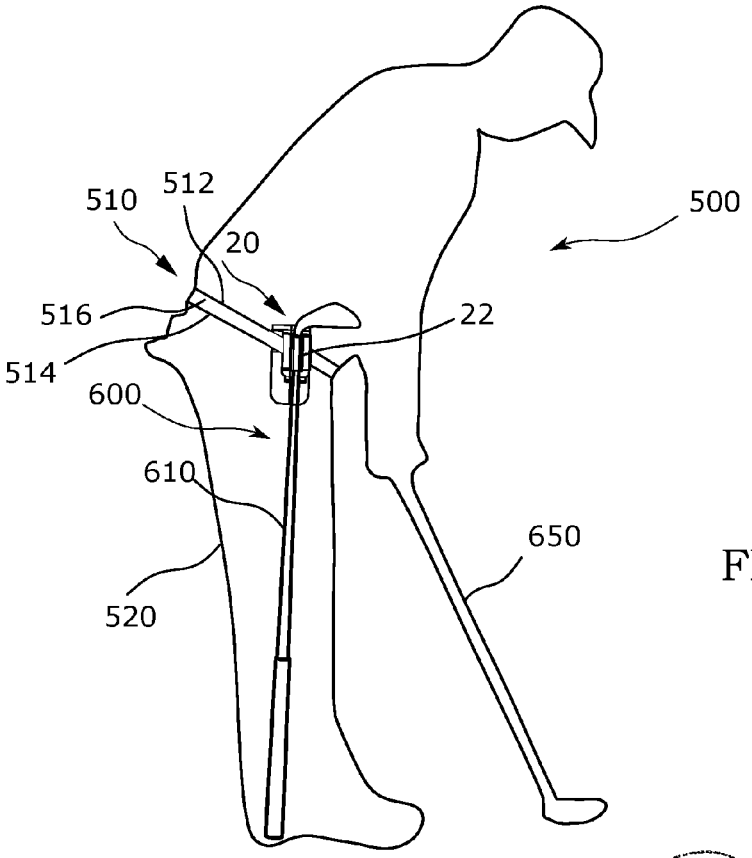
FIG. 5 is a reduced front elevation view of the belt clip being worn by a golfer.
Figure 11:
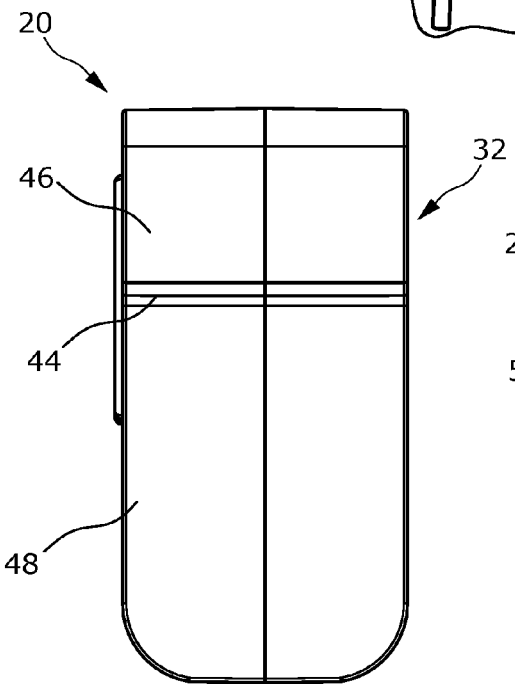
FIG. 11 is a rear view of the belt clip.

Referring initially to FIGS. 1-4, there are illustrated left front, right front, left rear, and right rear perspective views, respectively, of a belt clip for a golf club, the belt clip generally designated as 20. FIG. 5 is a reduced front elevation view of belt clip 20 being worn by a golfer 500. Golfer 500 has a belt 510 and a leg 520. A golf club 600 has a shaft 610. Belt clip 20 is removably attachable to belt 510 and includes a keeper 22 for receiving golf club 600. Belt as used herein encompasses belts, waistbands of articles of clothing, such as pants, shorts, or skirts, or similar items worn near the waist.

When worn, belt clip 20 is preferably positioned on the side of the golfer's body, although it may be slidably positioned at various points along belt 510. Keeper 22 positions shaft 610 of golf club 600 alongside leg 520 of golfer 500, so that golf club 600 does not impede the movement of golfer 500. Movement of the golfer includes walking, swinging a club, or performing other motions associated with the game of golf. In this manner, golf club 600 may be kept in keeper 22 while golfer 500 swings a second golf club 650. Golf club 600 and second golf club 650 may be readily interchanged by golfer 500 in preparation for taking a different shot.

FIGS. 6-11 are front, left and right side elevation, top and bottom plan, and rear views, respectively, of belt clip 20. Belt clip 20 has a front member 30 and a rear member 32 which each have a top edge 34. Top edges 34 are joined to one another by a top member 60. Directional terms are used herein with respect to the wearer; therefore 'front' and 'external' refer to the direction away from the wearer's body while 'rear' and 'internal' refer to the direction toward from the wearer's body. Front member 30 has an internal face 36 with a belt channel 40 extending laterally through the entire width of internal face 36. Belt channel 40 is shaped and dimensioned to receive belt 510 (see also FIG. 5). In this manner, front member 30 substantially surrounds the top edge 512, front face 516, and bottom edge 514 of the belt rather than contacting only the front of the belt. This arrangement enables belt clip 20 to fit tightly on the belt and resist pivoting motion.

Front member 30 has an external face 38 opposite interior face 36. Keeper 22 is disposed on external face 38 and is used for holding a portable device, such as golf club 600 (FIG. 5). Front member 30 also has an outwardly curving grip 42 disposed on a bottom edge 35 (see FIGS. 1 & 2). Grip 42 enables the wearer to easily release front member 30 from belt 510 for removal of clip 20.

Belt clip 20 is preferably unitarily formed of a resilient material, such as plastic.

In an embodiment, rear member 32 has a bend 44 which extends laterally, preferably across the entire width of the rear member, and separates rear member 32 into an upper portion 46 and a lower portion 48. Bend 44 positions lower portion 48 nearer to the internal face 36 than upper portion 46 is to internal face 36. Bend 44 therefore enables clip 20 to tightly grip belt 510, further resisting motion of clip 20 when worn.

Figure 12:
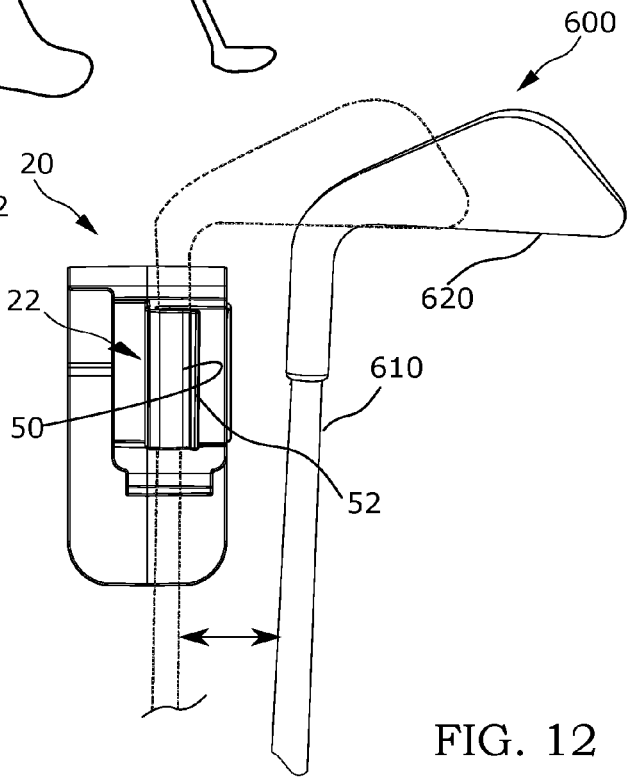
FIG. 12 is a reduced front elevation view of the belt clip showing a golf club in alternate positions.
Figure 9:
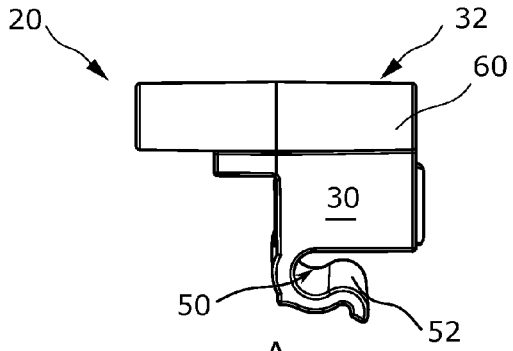
FIG. 9 is a top plan view of the belt clip.
Figure 7:
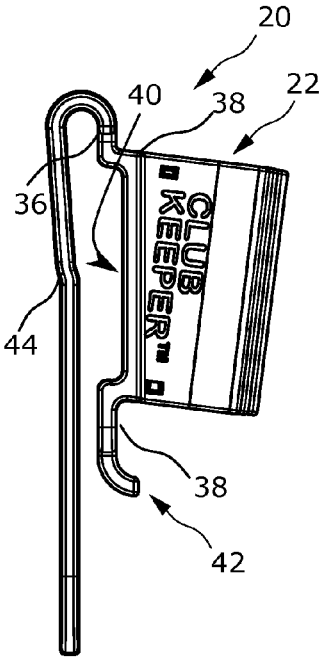
FIG. 7 is a left side elevation view of the belt clip.
Figure 6:
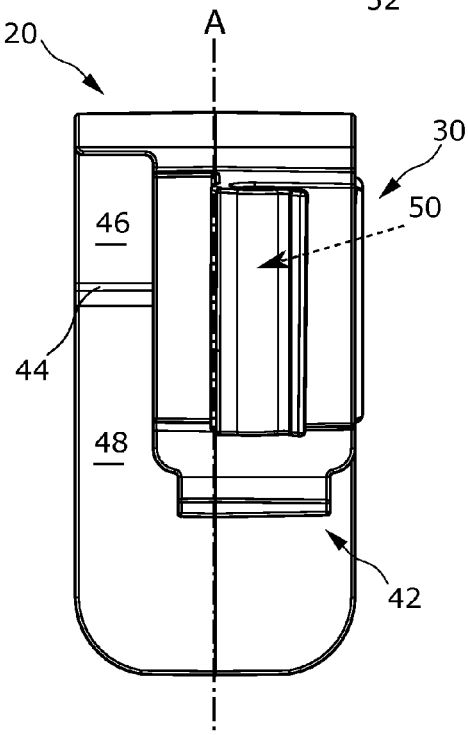
FIG. 6 is a front view of the belt clip.

In an embodiment of clip 20, keeper 22 has a keeper channel 50 for receiving the shaft 610 of golf club 600. FIG. 12 is a reduced front elevation view of belt clip 20 with golf club 600 in alternate positions. Keeper channel 50 has an open top 53, an open bottom 54, and a longitudinal side 55 which is open from the top to the bottom (see FIGS. 8-10). In use, shaft 610 of golf club 600 is placed in keeper channel 50 (the position shown in dashed lines) along the directional arrow of FIG. 12. Keeper channel 50 resiliently retains golf club 600, until its removal from clip 20 along the same directional arrow (position in solid lines). The head 620 of golf club 600 is positioned above keeper 22 and the shaft 610 extends below keeper 22.

The placement of golf club 600 in belt clip 20 in the manner described is a simple motion which can readily be performed with one hand. Golf club 600 is removable from belt clip 20 by performing these motions in reverse order, or by grasping and extending an optional keeper grip 52.

Figure 8:
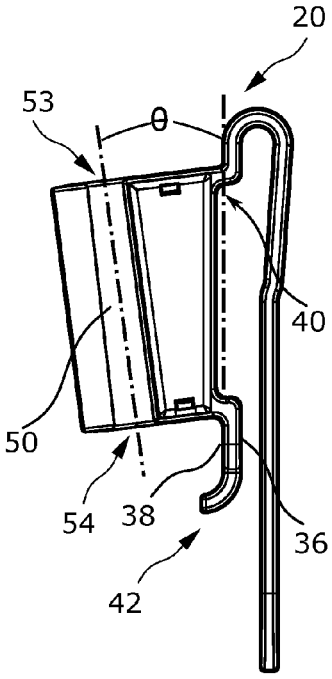
FIG. 8 is a right side elevation view of the belt clip.
Figure 10:
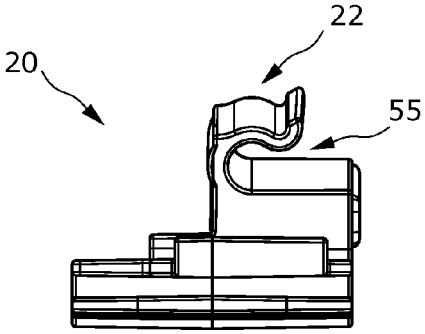
FIG. 10 is a bottom plan view of the belt clip.
Figure 13:
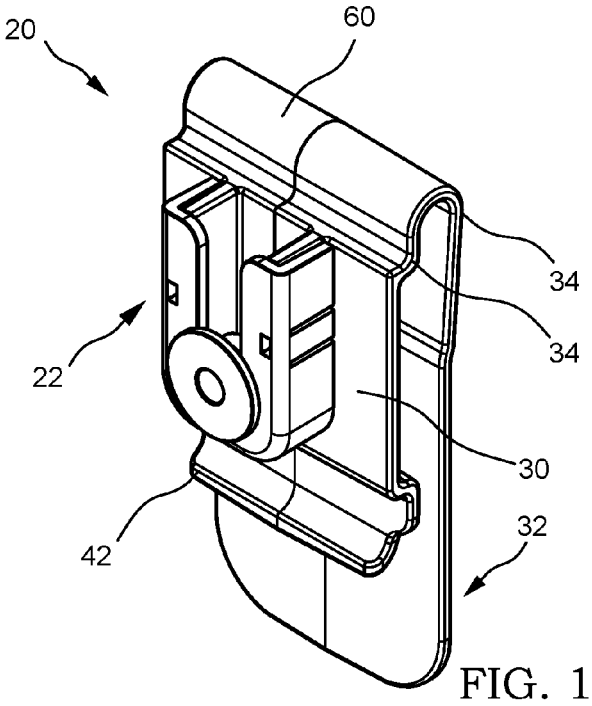
FIG. 13 is an upper front perspective view of a second embodiment of the belt clip.
Figure 14:
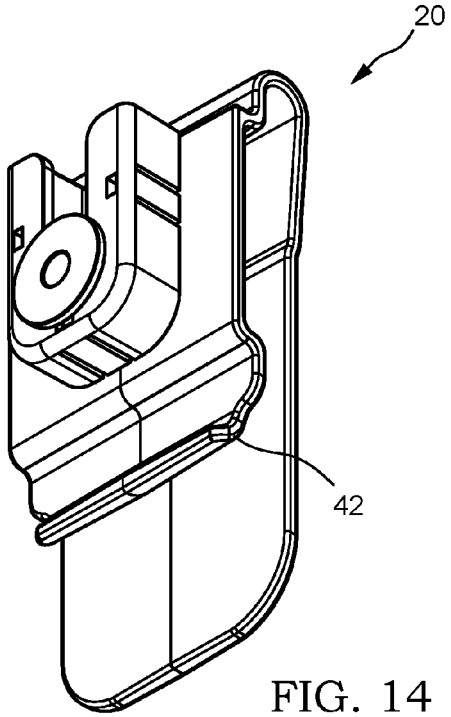
FIG. 14 is a lower front perspective view of the FIG. 13 embodiment.
Figure 15:
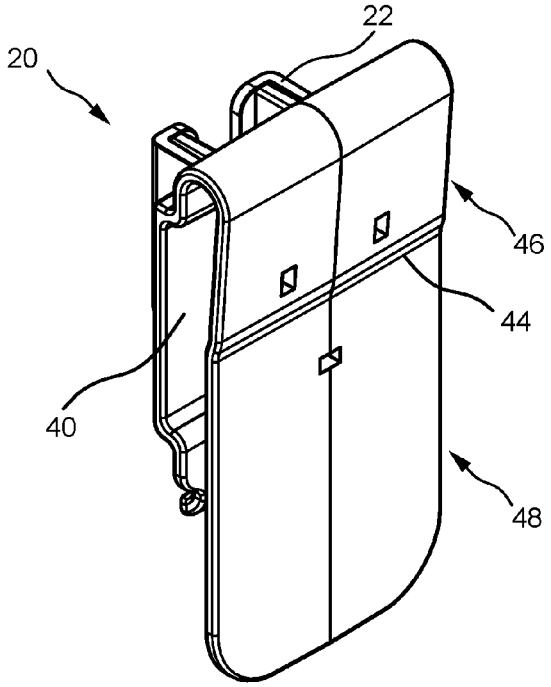
FIG. 15 is an upper rear perspective view of the FIG. 13 embodiment.
Figure 16:
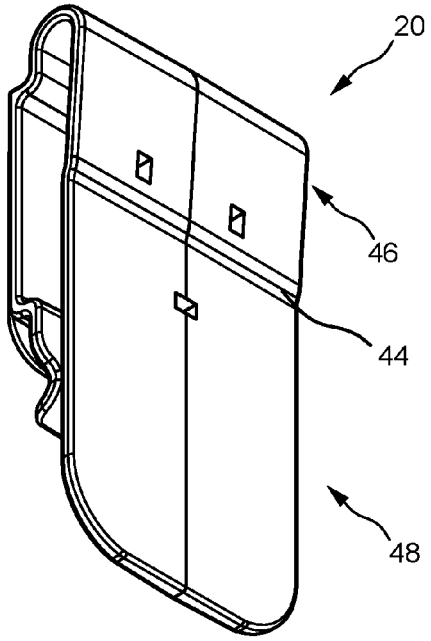
FIG. 16 is a lower rear perspective view of the FIG. 13 embodiment.
Figure 20:
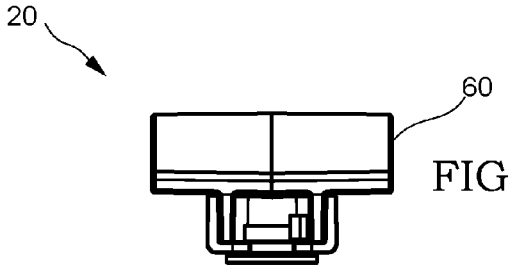
FIG. 20 is a top plan view of the FIG. 13 embodiment.
Figure 18:
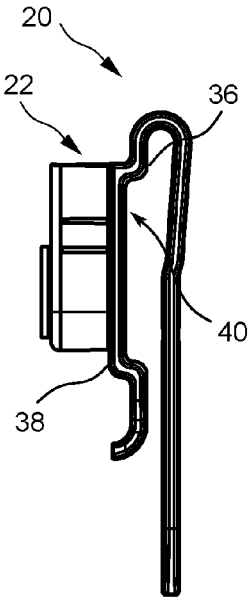
FIG. 18 is a left side elevation view of the FIG. 13 embodiment.
Figure 17:
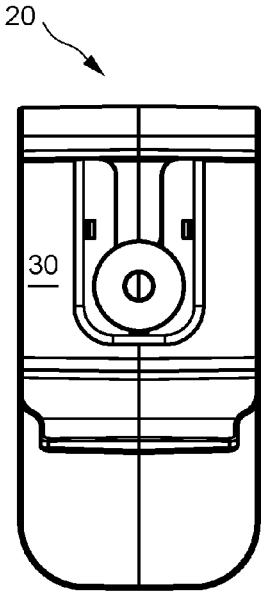
FIG. 17 is a front view of the FIG. 13 embodiment.
Figure 19:
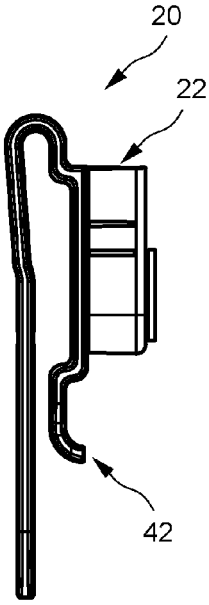
FIG. 19 is a right side elevation view of the FIG. 13 embodiment.
Figure 22:
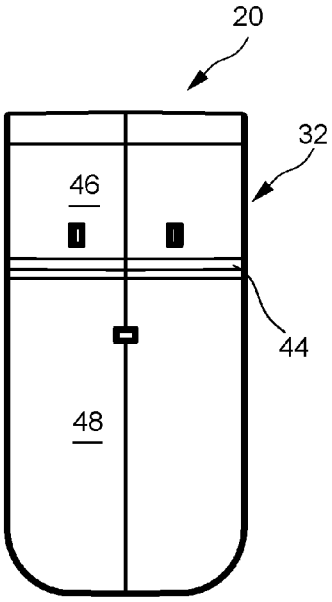
FIG. 22 is a rear view of the FIG. 13 embodiment.
Figure 21:
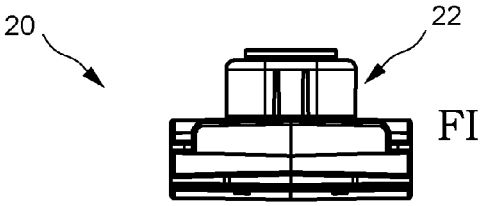
FIG. 21 is a bottom plan view of the FIG. 13 embodiment.

Referring again to FIGS. 6 & 8, keeper channel 50 is substantially parallel to the longitudinal axis 'A' of belt clip 20 when viewed from the front (FIG. 6), so that the golf club is held in a substantially vertical orientation when the wearer is standing upright. When viewed from the side, keeper channel 50 has an angle 'θ' with respect to belt channel 40 (FIG. 8). This angle causes the head of the golf club to be positioned farther away from the wearer's body than is the shaft, reducing the likelihood of the head contacting the wearer, which may be annoying or disruptive to the wearer's activity.

In another embodiment, belt clip 20 includes a golf tee keeper. The shank of a golf tee is received by the golf tee keeper so that both a golf club and golf tee may be worn on the belt.

FIGS. 13-22 are upper front, lower front, upper rear, and lower rear perspective views, front, left and right side elevation, top and bottom plan, and rear views, respectively, of another embodiment of belt clip 20. In this embodiment of belt clip 20, keeper 22 is a keeper for portable electronic devices, such as phones, GPS units, radios, and the like. Keeper 22 disposed on external face 38 of front member 30. The design of front and rear members 32 and 34 is as described for the embodiment of FIGS. 1-12. Numerous styles of keeper 22 may be envisioned which cooperate with belt clip 20 to support numerous devices on a wearer's belt.

In another embodiment, belt clip 20 cooperates with golf club 600 to form a system for holding golf club 600 on the belt 510 of golfer 500.

In terms of use, a method for holding a golf club 600 on the belt 510 of a golfer 500 having a leg 520 includes: (refer to FIGS. 1-13)

(a) providing a golf club 600 having a shaft 610;

(b) providing a belt clip 20 for holding golf club 600, belt clip 20 including:

(i) a keeper 22 for receiving golf club 600;

(ii) belt clip 20 removably attachable to belt 510;

(iii) belt clip 20 having a front member 30 having an internal face 36 which faces belt 510 when worn and an opposite external face 38;

(iv) a belt channel 40 extending laterally through internal face 36 and shaped and dimensioned to receive belt 510; and, (v) keeper 22 positioning shaft 610 so that golf club 600 does not impede the movement of golfer 500;

(c) attaching belt clip 20 to belt 510 by passing belt 510 through belt channel 40; and, (d) inserting golf club 600 into keeper 22.

The embodiments of the belt clip and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the belt clip and method should be construed as limiting the invention to a particular embodiment or combination of embodiments. The scope of the invention is defined by the appended claims.

I claim:

1. A belt clip, for holding a device and attaching to a belt having a top edge, a bottom edge, and a front face, the belt clip comprising:

a front member and a rear member each having a top edge, the top edges being joined to one another by a top member, the front member, rear member, and top member being unitarily formed;

the front member having an internal face which faces the belt when worn and an opposite external face;

a belt channel defined by the front member and the rear member, recessed into the internal face of the front member, and shaped and dimensioned so that the front member surrounds the top edge, the bottom edge, and a portion of the front face of the belt and the rear member fits snugly against the belt;

the front member having a bottom edge and an outwardly curving grip disposed on and extending downwardly from the bottom edge of the front member and curving outwardly from the external face of the front member; and, a keeper for the device disposed on the external face.

2. The belt clip according to claim 1, further including:

the rear member having an upper portion, a lower portion, and a bend extending laterally across the rear member and connecting the upper portion to the lower portion; and, the bend angled toward the internal face of the front member and positioning the lower portion nearer the internal face than is the upper portion, the lower portion configured to snugly fit against the belt.

3. The belt clip according to claim 1, further including:

the keeper having a keeper channel shaped and dimensioned to receive a shaft of a golf club having a head, so that the head is positioned above the keeper and the shaft extends below the keeper;

the keeper channel having an open top, an open bottom, and a longitudinal side which is open from the top to the bottom, the longitudinal side configured for lateral insertion and removal of the shaft of the golf club, and the keeper channel configured to resiliently retain the shaft;

the keeper channel substantially parallel to a longitudinal axis of the belt clip when viewed from the front, so that the golf club is held in a substantially vertical orientation; and, the keeper channel having an angle with respect to the belt channel when viewed from the side, to position the head of the golf club farther away from the belt channel than is the shaft.

4. A system for holding a golf club on the belt of a golfer, the belt having a top edge, a bottom edge, and a front face, the system comprising:

a golf club having a shaft;

a belt clip having a front member and a rear member each having a top edge, the top edges being joined to one another by a top member, the front member, rear member, and top member being unitarily formed;

the front member having an internal face which faces the belt when worn and an opposite external face;

a belt channel defined by the front member and the rear member, recessed into the internal face of the front member, and shaped and dimensioned so that the front member surrounds the top edge, the bottom edge, and a portion of the front face of the belt and the rear member fits snugly against the belt;

the front member having a bottom edge and an outwardly curving grip disposed on and extending downwardly from the bottom edge of the front member and curving outwardly from the external face of the front member;

a keeper for receiving the golf club disposed on the external face; and, the keeper positioning the shaft so that the golf club does not impede the movement of the golfer.

5. The system according to claim 4, further including:

the rear member having an upper portion, a lower portion, and a bend extending laterally across the rear member and connecting the upper portion to the lower portion; and, the bend angled toward the internal face of the front member and positioning the lower portion nearer the internal face than is the upper portion, the lower portion configured to snugly fit against the belt.

6. The system according to claim 4, further including:

the golf club having a head and a shaft;

the keeper having a keeper channel shaped and dimensioned to receive the shaft so that the head is positioned above the keeper and the shaft extends below the keeper;

the keeper channel having an open top, an open bottom, and a longitudinal side which is open from the top to the bottom, the longitudinal side configured for lateral insertion and removal of the shaft of the golf club, and the keeper channel configured to resiliently retain the shaft;

the keeper channel substantially parallel to a longitudinal axis of the belt clip when viewed from the front, to hold the golf club in a substantially vertical orientation; and, the keeper channel having an angle with respect to the belt channel when viewed from the side, to position the head of the golf club farther away from the belt channel than is the shaft.

7. A method for holding a golf club on a belt worn by a golfer having a leg, the method including:

(a) providing a golf club having a shaft;

(b) providing a belt clip for holding the golf club, the belt clip including:

(i) a keeper for receiving the golf club;

(ii) the belt clip removably attachable to the belt;

(iii) a front member and a rear member each having a top edge, the top edges being joined to one another by a top member, the front member, rear member, and top member being unitarily formed;

(iv) the front member having an internal face which faces the belt when worn and an opposite external face;

(v) a belt channel defined by the front member and the rear member, recessed into the internal face of the front member, and shaped and dimensioned so that the front member surrounds the top edge, the bottom edge, and a portion of the front face of the belt and the rear member fits snugly against the belt;

(vi) the front member having a bottom edge and an outwardly curving grip disposed on and extending downwardly from the bottom edge of the front member and curving outwardly from the external face of the front member; and, (vii) the keeper disposed on the external face of the front member, and positioning the shaft so that the golf club does not impede the movement of the golfer;

(c) attaching the belt clip to the belt by passing the belt through the belt channel; and, (d) inserting the golf club into the keeper.

* * * * *